US005777395A

United States Patent [19]

Rathmann

[11] Patent Number: 5,777,395

[45] Date of Patent: Jul. 7, 1998

[54] SAFETY ACTUATION OF VEHICLE DOOR-HANDLE OPERATED DOOR LOCKS USING SERIES CONNECTED SWITCHES AND ELECTRIC ACTUATOR

[75] Inventor: Klaus Rathmann, Frankfurt, Germany

[73] Assignee: VDO Adolf Schindling AG, Frankfurt, Germany

[21] Appl. No.: 738,392

[22] Filed: Oct. 25, 1996

[30] Foreign Application Priority Data

Dec. 20, 1995 [DE] Germany ..... 195 47 728.6

[51] Int. Cl.[6] ..... E05B 53/00

[52] U.S. Cl. ..... 307/10.2; 70/264

[58] Field of Search ..... 307/9.1, 10.1, 307/141.8, 113, 10.2; 70/237, 258, 264, 271, 277, 278; 318/266, 286, 468

[56] References Cited

U.S. PATENT DOCUMENTS 5,460,404 10/1995 Damisch et al. ..... 307/10.1
5,621,251 4/1997 Yamazaki ..... 307/10.2

FOREIGN PATENT DOCUMENTS 4228233 3/1994 Germany .

*Primary Examiner*—Richard T. Elms
*Attorney, Agent, or Firm*—Martin A. Farber

[57] ABSTRACT

In a circuit having an electric actuator in which the electric actuator and at least one operating device for the electric actuator are connected to a control device, a taking of safety-relevant aspects into account in the normal operation of the actuator is achieved by connecting the operating device and the electric actuator in series in a circuit.

8 Claims, 3 Drawing Sheets

SAFETY ACTUATION OF VEHICLE DOOR-HANDLE OPERATED DOOR LOCKS USING SERIES CONNECTED SWITCHES AND ELECTRIC ACTUATOR

FIELD AND BACKGROUND OF THE INVENTION

The present invention relates to an electric circuit having an electric actuator (9), in particular an electric actuator for a lock of a motor vehicle, the electric actuator (9) and at least one operating device for the electric actuator (9) being connected to a control device (3).

In Federal Republic of Germany OS 42 28 233, there is disclosed a circuit having an electric actuator which is connected to a central electronic system of the vehicle body. The actuator is actuated via a switch operated by a handle upon a turning of the handle, so that a door of a motor vehicle is freed by an electric motor for opening. In order to avoid the opening of the door during travel, a relay which switches as a function of a tachometer signal is provided, the relay interrupting a connecting line between the electronic system of the car body and the actuator when the motor vehicle preferably is not at a standstill or travelling at a slow speed so that the actuator cannot be controlled in this case by the central electronic system of the car body.

Other safety measures for the normal operation of the actuator are not provided.

SUMMARY OF THE INVENTION

It is an object of the invention to provide a circuit of simple construction which, in normal operation, takes into account safety-relevant aspects such that, in particular, a process which would lead to a dangerous situation cannot be brought about by the actuator.

According to the invention, the operating device and the electric actuator (9) are connected in series in a circuit.

Due to the fact that the operating device and the electric actuator are connected in series in a circuit, after an intended actuation of the operating device has been noted by the control device, the electric actuator is connected in so that the operating device in the circuit in which the electric actuator is located is also closed. In this way, unintended operation of the actuator which could lead to a dangerous situation is effectively avoided.

As a further development of the invention, the operating device has at least one selector switch, such as a two-way switch (4, 5), in which connection, when the operating device is not actuated, the current is interrupted by the two-way switch (4, 5) and the two-way switch is arranged in a signal circuit (12) and power circuit (6). In this way, a simple construction is achieved so that the opening of the signal circuit can be noted by the actuator and, at the same time, the electric actuator can be connected after the correct actuating of the operating device has been detected and noted. In this way a verification of the operating device, in particular of the two-way switch, is effected in a simple manner so that the electric actuator is only connected (actuated) when the operating device is operating properly.

As a further aspect of the invention, a switch device which operates as a function of the actuation of the operating device is connected in the circuit. After noting the actuation of the operating device and evaluation as to whether this actuation has taken place correctly, the actuator is connected, i.e. actuated because the operating device in the circuit (power circuit) is connected and the switch device also actuated (closed), and a process is triggered by the actuator. For further simplification of the construction, the switch device is integrated in the control device (3). There is to be considered herein, for instance, a relay or an electronic switch which is integrated in the actuator and actuated by it.

As a further development of the invention, upon the actuation of the operating device, the electric actuator (9) is connected by the two-way switch (4, 5) to a terminal (7) of a source of voltage lying in the circuit. This has the advantage that the signal circuit and the power circuit can have a common base (for instance ground) which results in a further simplification of the construction (in particular of the wiring). This is true in particular when the operating device and the electric actuator or else the electric actuator and the control device are separated in space from each other.

As a further feature of the invention, the switch device can be actuated after an error-free switching of the operating device (of the two-way switch). In this way, assurance is had that only after the error-free actuation and switching of the operating device (of the two-way switch which opens the signal circuit and closes the power circuit), the switch device is actuated and the actuator thus connected.

According to a development of the invention, an operating device (two-way switch (4)) can be actuated by a door inside handle and another operating device (two-way switch (5)) can be actuated by a door outside handle. The actuator (9) is activated by electric motor or electromagnetically. Also, there is directly or indirectly actuated a locking pawl which locks a rotary latch in a locking position or releases the rotary latch into an open position.

BRIEF DESCRIPTION OF THE DRAWINGS

With the above and other objects and advantages in view, the present invention will become more clearly understood in connection with the detailed description of preferred embodiments, when considered with the accompanying drawings, of which

DETAILED DESCRIPTION OF THE PREFERRED EMBODIMENTS

Figure 1:
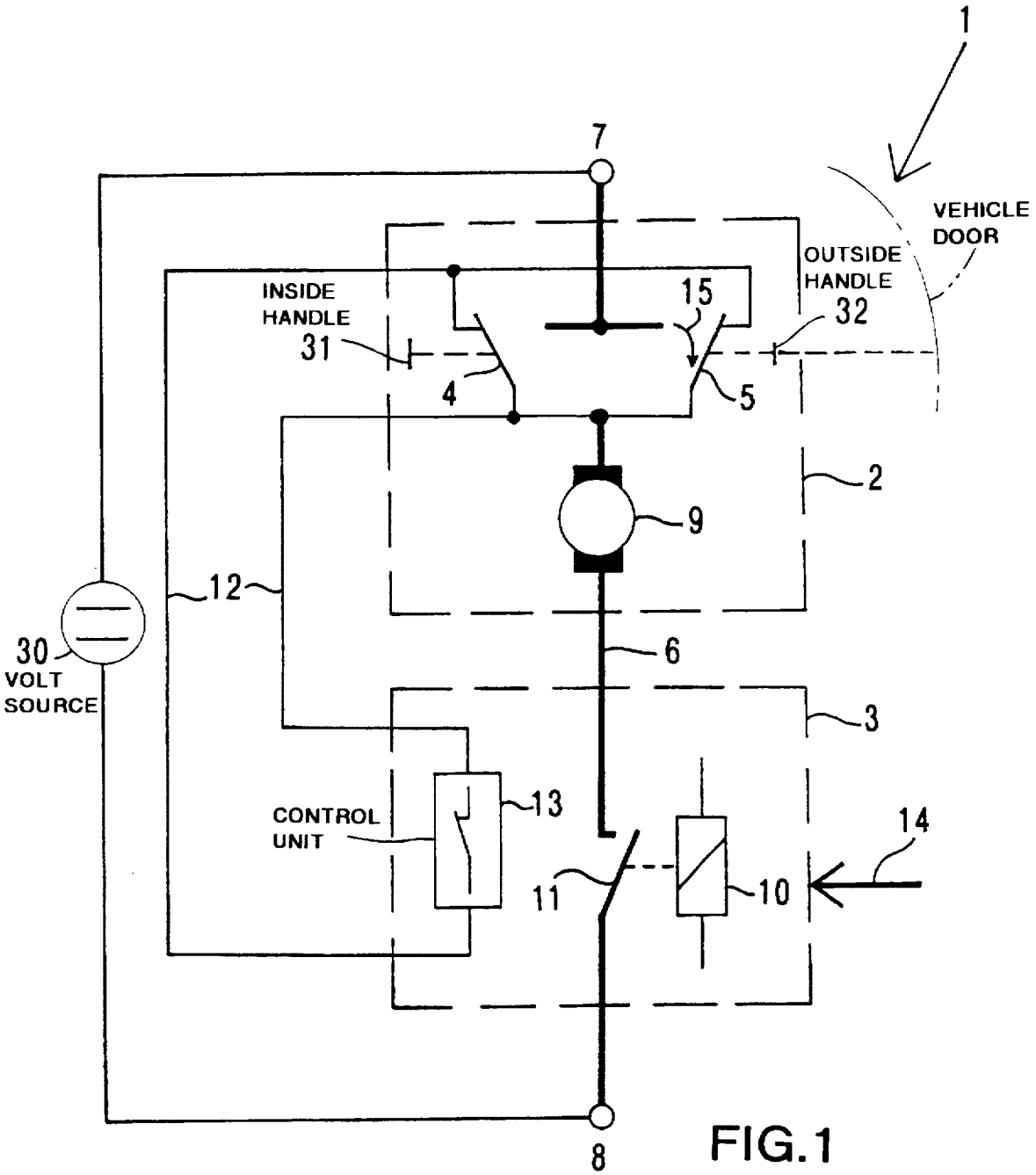
FIGS. 1 and 2 are circuit diagrams of the invention with alternative connection of switches.
Figure 2:
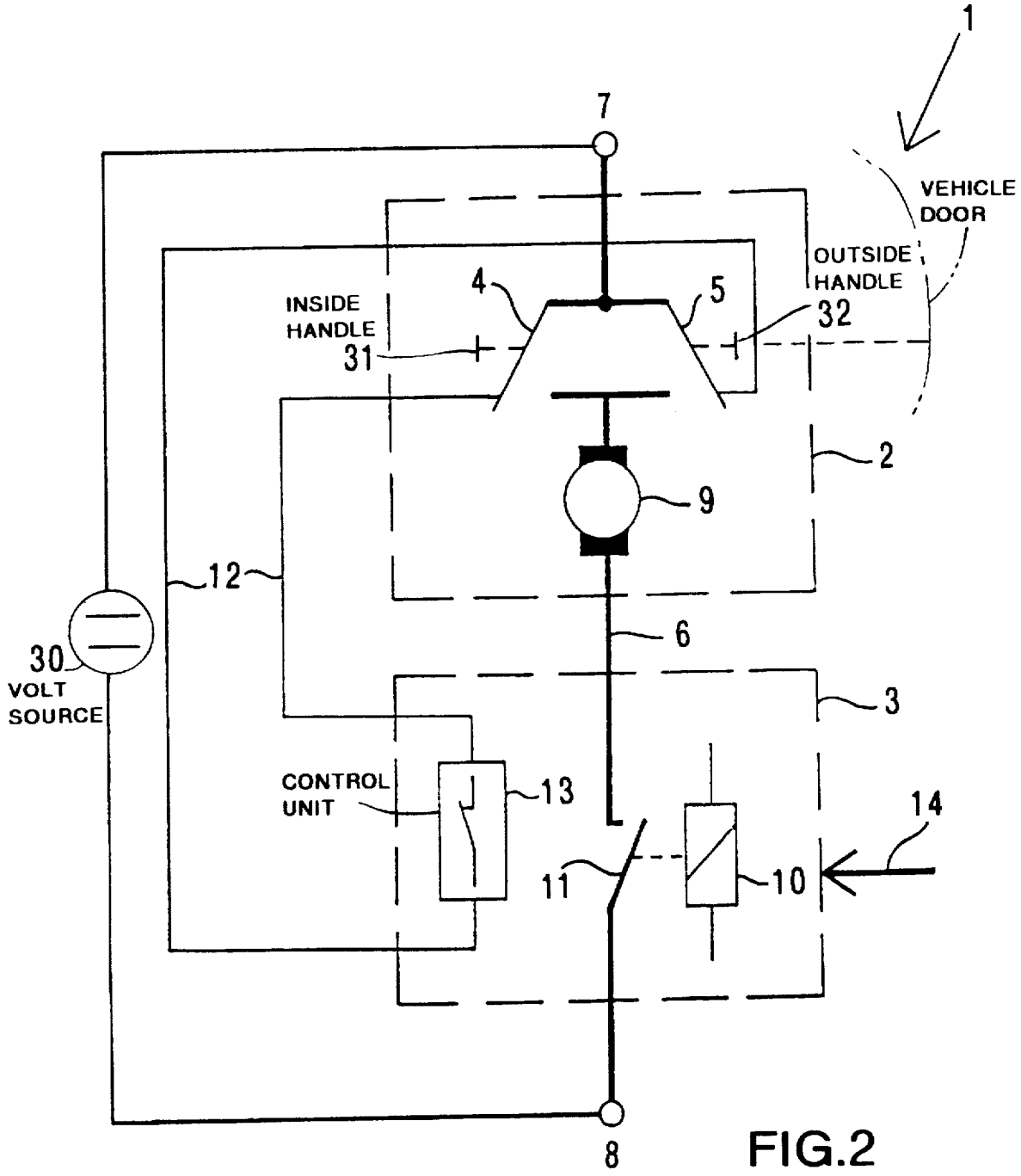

A circuit 1 in accordance with the invention consists of an assembly 2 and a control device 3, the assembly 2 having as operating device a two-way switch 4 and another two-way switch 5. An electric actuator 9 is arranged in a power circuit 6 which is located between a positive terminal 7 and a negative terminal 8 (for instance, ground) of a source of voltage 30. The control device 3 has, as switch means, a relay 10 the switch contact 11 of which lies in the power circuit 6. The two-way switches 4 and 5 of the assembly 2 are connected via a signal circuit 12 to the control device 3, the two-way switches 4 and 5 being arranged in parallel within the signal circuit in the embodiment shown in FIG. 1 and in series in accordance with the embodiment shown in FIG. 2. In the control device 3 there is a control unit 13 which assumes or monitors the activating of the two-way switches 4 and 5 and their actuation in the signal circuit 12. Further input variables on which the operation of the actuator 9 depends can be fed to the control device 3 via an input 14.

The circuit 1 is used, for instance, in connection with a door lock 29 (FIG. 1A), operated by electric motor, of a motor vehicle in which the actuator 9 is developed, for instance, as an electric motor (with or without gears or movement converter) or electromagnet, the movement of which acts on a pawl 17, known per se, the pawl 17 locking a rotary latch 19 (locks the door) or releasing it (opens the door). The two-way switch 4 is connected, for instance, to a door inside handle 31 and the two-way switch 5 to a door outside handle 32, so that when the two-way switches 4 and 5 are placed in active position in the signal circuit 12 by the control unit 13, the electric actuator 9 can be connected or disconnected. This means that when the two-way switches are placed in active position and the door inside handle or the door outside handle is operated, the previously locked door is opened by actuation of the actuator 9. In accordance with the invention, it is now provided that the actuation of a two-way switch 4 and/or 5 is detected by the control device 3 in the manner that the signal circuit 12 is interrupted. At the same time, the power circuit 6 is closed so that (in the absence of the relay 10 and of the switch contact 11), the electric actuator 9 is activated as long as the two-way switch 4 or the two-way switch 5 is actuated. In order to obtain a specific period of time for the connecting of the actuator 9 and for taking into account the safety-relevant aspects, the switch contact 11 of the relay 10 is arranged in the signal circuit 12, the relay being actuated by an actuation of the two-way switch 4 or 5 or else of the other input variables which are fed via the input 14. If a two-way switch 4 or 5 is actuated, this is recognized on the one hand via the signal circuit 12 by the control device 3, and results in actuation of the relay 10, so that the switch contact 11 closes.

At the same time, however, the two-way switch 4 or 5 must also close the power circuit 6 in order to connect the electric actuator 9. This has several advantages, so that, on the one hand, in the event that the switch path 15, which is shown by way of example in the drawing at the two-way switch 5, is bridged over by environmental influences such as, for instance, moisture or dirt, this defect does not lead to an actuating or connecting of the actuator 9 since the two-way switch 5 is closed and it is recognized, via the signal circuit 12, by the control device 3 that an actuation of the actuator 9 is not to take place.

On the other hand, the switch contact 11 is only closed when the intentional actuation of the two-way switch has taken place. In this connection, it can be provided that, in the event that a two-way switch is closed for too long a time, the actuation of the actuator 9 is interrupted in advance by the switch contact 11, for instance as a function of other input variables of the input 14. The actuating of the relay 10 via another input variable can, for instance, take place when another sensor (not shown) notes that the pawl or the rotary latch has reached an opening position, so that a further actuation of the actuator 9 is then no longer necessary, and the latter can be disconnected.

In the embodiment described, the assembly 2, together with its components, is advantageously arranged in the door, the trunk lid, the trunk itself or a similar part of the motor vehicle, while the control device 3 is arranged in an inner region (interior) of the motor vehicle or is a part of an extensive body electronic system of the vehicle. In addition, other, different combinations of the components are also possible.

Furthermore a switching of the actuator 9 which is known per se but not shown in the drawings is provided which permits a reversal of direction of turning or a reversal of the direction of movement (in the case of linearly acting actuators) (for instance by reversing the polarity of the source of voltage [30 at terminals 7 and 8]).

Figure 1A:
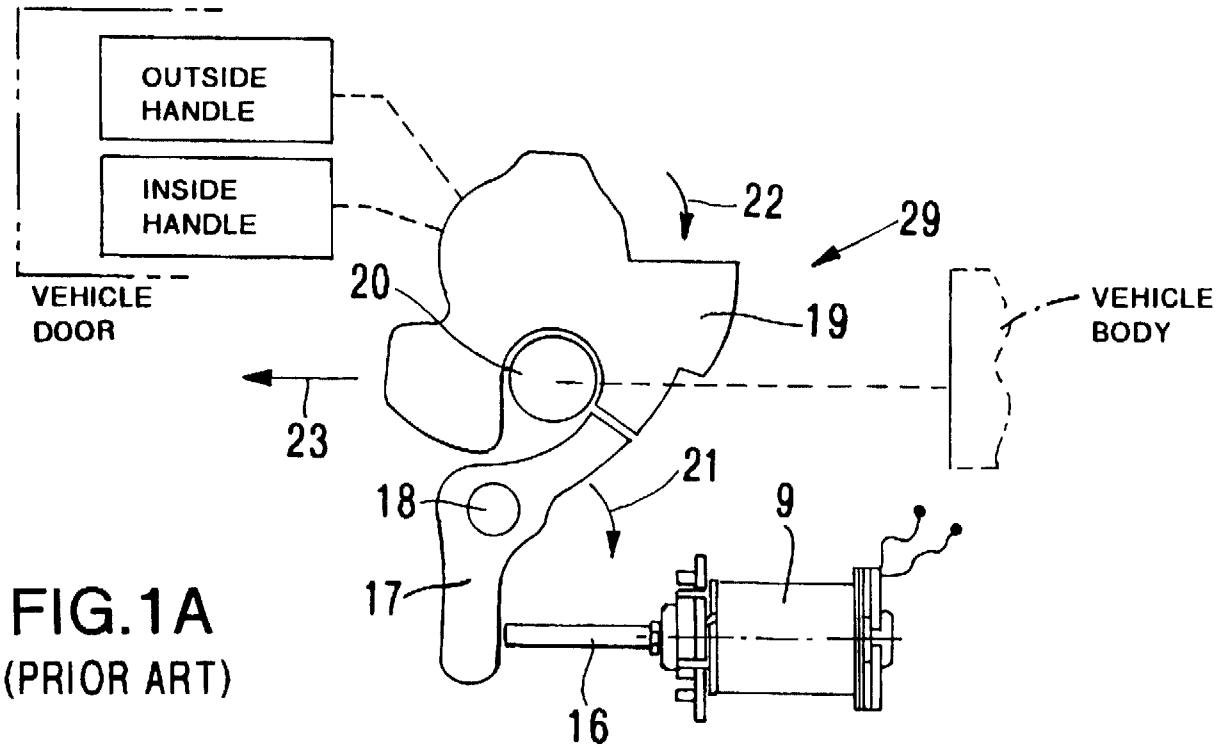
FIG. 1A (PRIOR ART)
FIG. 1A shows detail of a locking device of the prior art.

FIG. 1A shows the actuator 9, serving as a positioning device, which is developed as an electromagnet having a longitudinally displaceable plunger 16. The plunger 16 acts on a pawl 17 which is mounted on a pivot pin 18. In the position of the pawl shown in FIG. 1A, it locks a rotary latch 19 which is approximately U-shaped and the two arms of which grip around a closing bolt 20 which is arranged, fixed on the body of a vehicle, or a door. If the actuating device (change-over switch 4 or change-over switch 5 is actuated, the signal circuit 12 is closed and the relay 10 is actuated by the control unit 13. Thereupon, the switch contact 11 in the power circuit 6 is closed so that the positioning device 9 can be actuated. With reference to FIG. 1A, this means that the plunger 16 of the actuator 9 moves to the left as seen in FIG. 1A, and the pawl 17 turns around the pivot pin 18 in the direction of movement 21. Thereby, the rotary latch 19 can turn in the direction of rotation 22 so that the closing bolt 20, which may be arranged on the door, is released with the door from the rotary latch 19 in the direction of movement 23.

Thus FIG. 1A shows the locking position of the rotary latch 19, an opening position being reached when the actuator 9 is energized via the switch circuit shown in FIG. 1.

I claim:

1. A circuit for actuating a lock in a vehicle, the lock being coupled to an inside handle and an outside handle for operation of the lock, the circuit comprising:

a control device, an electric actuator for actuating the lock, and at least an operating device, the operating device serving to operate the electric actuator and connecting with the control device;

wherein the operating device comprises a plurality of switches connected to respective ones of said handles; and the operating device and the electric actuator are connected in a series circuit.

2. A circuit according to claim 1, further comprising:

a power circuit for delivering electric power to said actuator, and a signaling circuit;

wherein said plurality of switches of the operating device has at least one selector switch wherein, upon deactivation of the operating device, electric current is interrupted by the selector switch, the selector switch connecting with the signal circuit and the power circuit.

3. A circuit according to claim 1, wherein said control device comprises a switch device which operates as a function of a state of actuation of the operating device.

4. A circuit according to claim 3, wherein said switch device is integrated in said control device.

5. A circuit according to claim 2, wherein upon actuation of the operating device, the electric actuator is connected by the selector switch to a terminal of a source of voltage powering the circuit.

6. A circuit according to claim 2, wherein said control device comprises a switch device which operates as a function of a state of actuation of said operating device; and the switch device is actuatable after an error-free switching of said selector switch of the operating device.

7. A circuit comprising:

a control device, an electric actuator, and at least on operating device, the operating device serving to operate the electric actuator and connecting to the control device:

a power circuit for delivering electric power to said actuator, and a signaling circuit;

wherein the operating device and the electric actuator are connected in a series circuit;

the operating device has at least one selector switch wherein upon deactivation of the operating device, electric current is interrupted by the selector switch, the selector switch being connected to the signal circuit and the power circuit;

said selector switch is a first selector switch, and said operating device further comprises a second selector switch;

the circuit is installed in a vehicle having a door with an inside door handle and an outside door handle;

said first selector switch is actuatable by the door inside handle and said second selector switch is actuatable by the door outside handle;

said actuator comprises an electromagnetically movable part, a locking pawl and a rotary latch; and the electromagnetically moveable part provides for actuation of the locking pawl which locks the rotary latch in a locking position or releases the rotary latch into an open position.

8. A circuit according to claim 7, wherein the actuator comprises an electric motor having said electromagnetically movable part.

* * * * *